US009119459B2

(12) United States Patent
Kim et al.

(10) Patent No.: US 9,119,459 B2
(45) Date of Patent: Sep. 1, 2015

(54) VARIABLE SUSPENSION SYSTEM FOR BACKPACKS

(71) Applicant: Boreas Gear, Inc., San Francisco, CA (US)

(72) Inventors: Tae Kim, San Francisco, CA (US); Alexei Tcherepanov, San Francisco, CA (US)

(73) Assignee: Boreas Gear, Inc., San Francisco, CA (US)

( * ) Notice: Subject to any disclaimer, the term of this patent is extended or adjusted under 35 U.S.C. 154(b) by 238 days.

(21) Appl. No.: 13/757,452

(22) Filed: Feb. 1, 2013

(65) Prior Publication Data

US 2013/0206805 A1 Aug. 15, 2013

Related U.S. Application Data

(60) Provisional application No. 61/596,805, filed on Feb. 9, 2012.

(51) Int. Cl.

| | |
|---|---|
| ***A45F 3/00*** | (2006.01) |
| ***A45F 3/04*** | (2006.01) |
| ***A45F 4/02*** | (2006.01) |
| ***A45F 3/08*** | (2006.01) |

(52) U.S. Cl.
CPC .. *A45F 3/08* (2013.01); *A45F 3/047* (2013.01)

(58) Field of Classification Search
CPC ..... A45F 3/08; A45F 3/04; A45F 3/047
USPC ..... 224/631, 633, 634, 635, 153, 641, 630
See application file for complete search history.

(56) References Cited

U.S. PATENT DOCUMENTS

| | | | | |
|---|---|---|---|---|
| 4,074,839 | A * | 2/1978 | Wood et al. | 224/635 |
| 5,005,744 | A * | 4/1991 | Gleason | 224/630 |
| 5,320,262 | A * | 6/1994 | Levis | 224/630 |
| 5,529,230 | A * | 6/1996 | Smith | 224/625 |
| 5,547,246 | A * | 8/1996 | Lambert | 297/129 |
| 5,564,612 | A * | 10/1996 | Gregory | 224/633 |
| 5,762,251 | A * | 6/1998 | Gleason | 224/635 |
| 6,837,409 | B2 * | 1/2005 | Lemanski, II | 224/579 |
| 7,028,873 | B1 * | 4/2006 | Collier et al. | 224/628 |
| 8,181,834 | B1 * | 5/2012 | Howell | 224/630 |
| 8,353,434 | B2 * | 1/2013 | Clayton et al. | 224/634 |
| 8,678,258 | B1 * | 3/2014 | Knight et al. | 224/628 |
| 2004/0007605 | A1 * | 1/2004 | Mares | 224/630 |
| 2005/0035170 | A1 * | 2/2005 | Sears et al. | 224/630 |
| 2006/0266781 | A1 * | 11/2006 | Howell | 224/628 |
| 2011/0284608 | A1 * | 11/2011 | Staudecker et al. | 224/633 |
| 2012/0012629 | A1 * | 1/2012 | Buffinton | 224/633 |

* cited by examiner

*Primary Examiner* — Brian D Nash
*Assistant Examiner* — Derek Battisti

(57) ABSTRACT

An adjustable suspension system for a backpack includes a flexible frame, a trampoline and a tension adjustment mechanism. The suspension system can allow the user to control the position of the frame anywhere between a flat position directly adjacent to the user's back and a fully bowed position that arches away from the user's back.

20 Claims, 8 Drawing Sheets

VARIABLE SUSPENSION SYSTEM FOR BACKPACKS

CROSS REFERENCE TO RELATED APPLICATIONS

This application claims priority to U.S. Patent Application No. 61/596,805, "Variable Suspension System" filed Feb. 9, 2012, which is hereby incorporated by reference in its entirety.

BACKGROUND

A backpack is, in its simplest form, includes a storage container that is secured to two shoulder straps. The storage container can be filled with items that user wishes to carry and the straps can be placed over the user's shoulders which support the weight of the backpack. Backpacks can have frames or be frameless. Frame backpacks were designed with a fabric storage container coupled to a rigid frame. The frame can be covered by netting which prevents contact between the frame or storage pack and user's back. Framed backpacks are designed to give the user more support and protection and better weight distribution than a simple, frameless strapped bag. A problem with traditional frame backpacks is that the frame is a rigid structure and the netting is not easily adjustable. What is needed is an improved variable suspension system for backpacks.

SUMMARY OF THE INVENTION

The present invention is directed towards an improved variable suspension system for backpacks that includes a flexible frame, a trampoline and an adjustment mechanism. In an embodiment, the top and bottom portions of the flexible frame can be coupled to the trampoline and the adjustment mechanism. In a normal state, the flexible frame can be substantially flat and one side of the frame can rest against one side of the trampoline. This can be useful when the user wishes to have the backpack positioned close to the body. This can improve warmth if the user is in cold ambient conditions and may also provide a more aerodynamic profile if the user is bicycling and a more stable position on the rider's back. However, ventilation to the back of the user will be very limited because of the close proximity of the backpack to the body and this may be uncomfortable to the user if the backpack is worn in hot climates.

The inventive suspension system allows the backpack to be adjusted so that the flexible frame and storage pack can be moved away from the trampoline. The adjustment mechanism can be attached between a top of the frame and a top of the trampoline which can be made of a soft breathable mesh type material. By tensioning the adjustment mechanism, the frame can bow away from the trampoline which also moves the storage pack away from the trampoline. The amount of bowing can be controlled by the amount of tension applied to the frame by the adjustment mechanism. This bowing of the frame creates a space that allows air to circulate between the storage pack and the user's back. This also moves the weight off the user's back and onto the shoulders and possibly the legs and hips if the backpack includes a waist belt strap. In an embodiment, the adjustment mechanism is an adjustable strap. By increasing the tension in the strap, the tension in the trampoline is also increased and the flexible frame bows farther away from the trampoline. In other embodiments, the adjustment mechanism can be any other device that allows the user to adjust the tension in the frame.

The adjustable suspension apparatus can be made of a thin elongated light weight structural material such as aluminum or carbon fiber that provides strength to the backpack but is also elastic and flexible. Frame may also be coupled to padding that provides additional cushioning to the user's back when the backpack is in the flat configuration.

In an embodiment, the adjustable suspension apparatus can be releasably attached to the storage pack. In an embodiment, an upper portion of the suspension apparatus can be held within in a top pocket of the storage pack and a lower portion of the suspension apparatus can be held within a bottom pocket of the storage pack.

DETAILED DESCRIPTION

Figure 1:
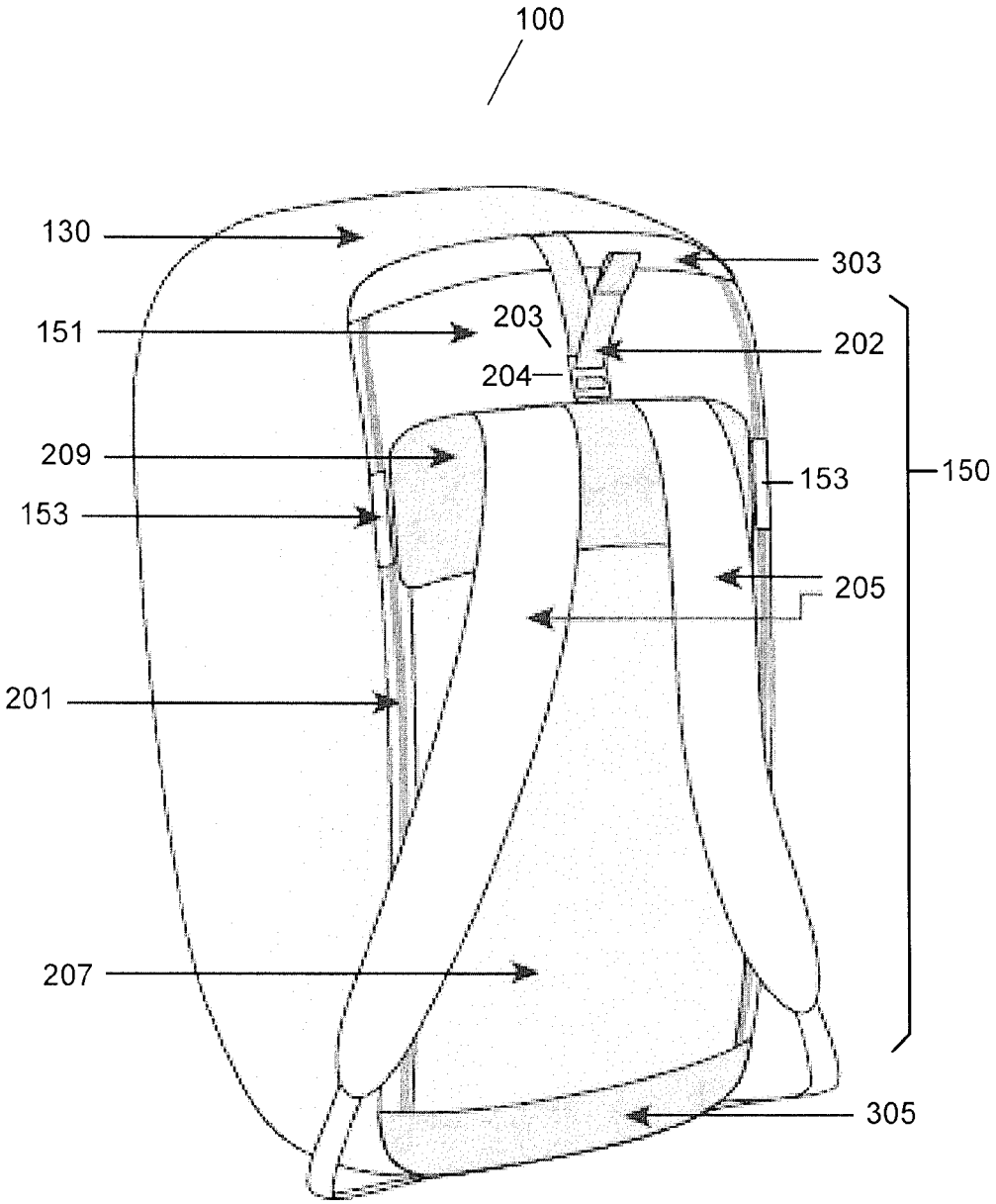
FIG. 1 is a view of a backpack with an embodiment of the inventive suspension apparatus.

With reference to FIG. 1, an embodiment of a backpack 100 is illustrated having a variable suspension system 150 that is coupled to a pack 130. The pack 130 can be made of a lightweight high strength material such as ballistic nylon. The pack 130 can have an internal volume and pockets which can be used to store items. The pack 130 can also include closure mechanisms such as zippers, Velcro, straps, etc. to prevent the items from accidentally falling out of the pack 130.

The suspension system 150 includes a frame 201, an adjustment mechanism 203, shoulder straps 205 and a suspension trampoline 207. The inventive system allows the user to adjust the tension in the suspension trampoline 207 and the curvature of the flexible frame 201. In this embodiment, the adjustment mechanism 203 includes a strap 202 and buckle 204. One portion of the adjustment mechanism 203 is coupled to the top of the frame 201 and an opposite side of the adjustment mechanism 203 is coupled to the top of the trampoline 207. Because the adjustment mechanism 203 is pulling the top center portion of the trampoline 207, a stiff panel 209 can be coupled to the top of the trampoline 207 to distribute the tension across the entire width of the trampoline 207. In other embodiments, the adjustment mechanism 203 can include multiple devices that can distribute the tension across the width of the trampoline 207 so that a stiff panel 209 may not be necessary. A soft cushion material can be attached to the stiff panel 209 as well as the back area 151 of the pack 130 facing the user's body so that the backpack 100 is comfortable to carry.

In an embodiment, the frame 201 can be made of thin aluminum tubing and the frame 201 can be generally rectangular in shape. The upper edge of the frame 201 can be placed within a pocket 303 at a top portion of the pack 130 and the bottom edge of the frame 201 can be placed within a pocket 305 at a bottom portion of the pack 130. The frame 201 may also be placed through loops 153 that can be coupled to the stiff panel 209. The loops 153 can hold the frame 201 in place and prevent it from moving sideways when this portion of the frame 201 is in compression. In an embodiment, the backpack 100 can be less than about 35 cm wide and less than 70 cm tall.

Figure 2:
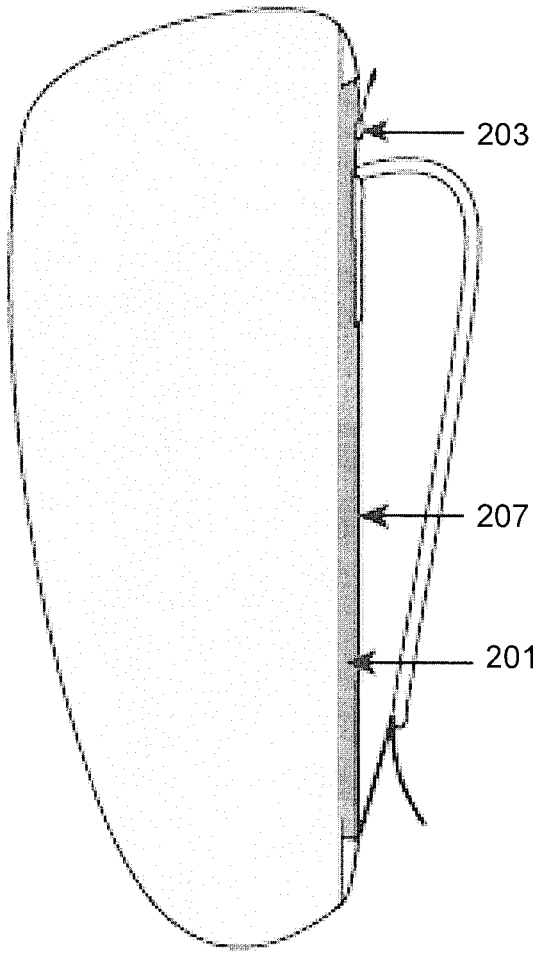
FIGS. 2 and 3 are side views of a backpack with an embodiment of the inventive suspension apparatus.
Figure 3:
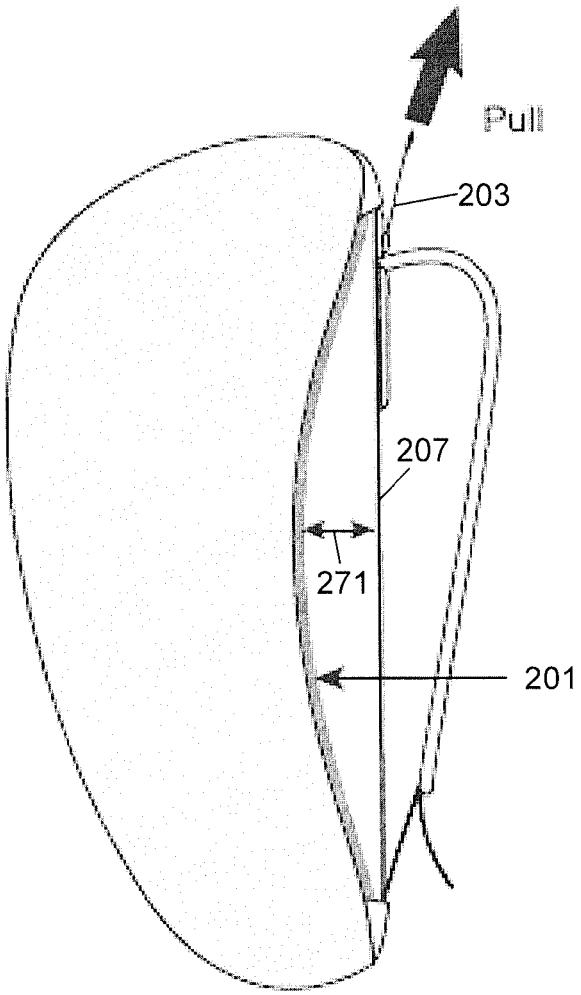

With reference to FIGS. 2 and 3, side views of the backpack 100 and suspension system 150 are illustrated. FIG. 2 shows the suspension system 150 in a non-tensioned state. The tension in the adjustment mechanism 203 has been released and the flexible frame 201 can be substantially planar or flat against the trampoline 207. This causes the storage pack 130 to rest very close to the trampoline 207. As shown, there is little or no space 271 between the frame 201 and the trampoline 207.

For example, the user may wish to have a very low profile backpack 100. This flat configuration can be useful in many situations. The user may wishes to have a low profile backpack 100 for more aerodynamic bicycling. Having the weight of the items in the pack close to the body can also provide a more stable backpack 100 while hiking or climbing. The user might be skiing with the backpack 100 and may want to sit as far back on the chair lift as possible. The weather may be cold and the user may want to have the backpack 100 close to the body for additional insulation, wind and rain protection. The flat profile configuration also occupies less space when the pack is in storage.

With reference to FIG. 3, in the tensioned state, the frame 201 flexes in an arch creating a large space 271 between the frame 201, pack 130 and the trampoline 207. The backpack 100 may be designed to carry a substantial amount of weight and as the user moves, the items in the pack 130 may shift and the movement of items that are against the frame 201 may be felt by the user if the backpack 100 is in the flat configuration. My switching to the tensioned state, the pack 130 is away from the trampoline 207 and the user. Thus, the user will not feel the movement of items against the user's back. In addition to comfort, this "stand-off" provides the additional benefit of creating air circulation between the frame 201 and the user's back. This can allow perspiration from the user to more easily wick away from the user and evaporate during hot ambient conditions.

As illustrated in FIGS. 1-3, in an embodiment, the tension adjustment mechanism 203 can include a strap 202 and buckle 204. When the strap 202 is pulled as shown in FIG. 3, the top of the frame 201 is pulled down by the tension adjustment mechanism 203 and the frame 201 bends to the illustrated bowed shape away from the trampoline 207. The buckle 204 can hold the strap 202 in this tensioned position. To change the backpack 100 back to flat configuration, the user can manipulate the buckle 204 to release the strap 202 which causes the backpack 100 and frame 201 to return to the flat state. Although, the backpack is illustrated in the flat FIG. 2 and fully tensioned FIG. 3 settings, the tension setting is infinitely variable. Thus, a user can pick a tension anywhere in the middle as desired.

Although, the application describes the tension adjustment mechanism 203 as a single strap 202 and buckle 204, in other embodiments any other tension mechanism can be used with the inventive suspension system. For example, a Velcro hook and loop coupling device can be used. Alternatively, a threaded screw system with a turnbuckle can be used. The application also describes the tension mechanism 203 as being located at the top center of the backpack 100. However, in other embodiments, the tension mechanism 203 can be mounted at various other locations. For example, the tension mechanism may include multiple buckles that can be at different portions of the upper edge of the trampoline 207. Alternatively, the tension mechanism 203 as being located at the bottom of the backpack 100 and the top of the trampoline 207 can be directly coupled to the frame 201.

Figure 4:
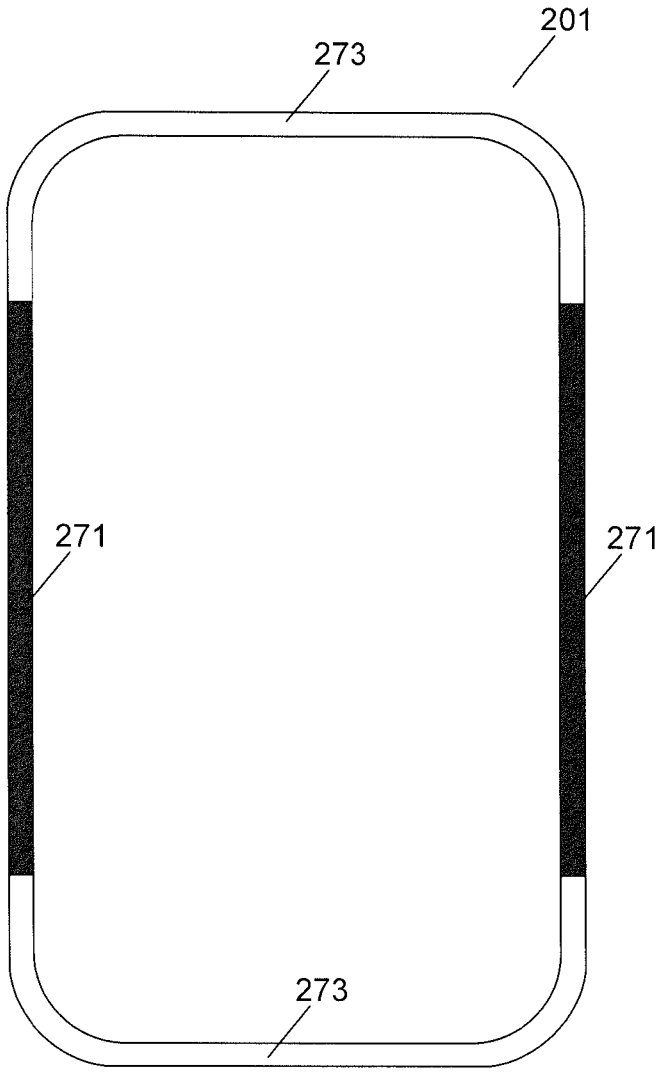
FIGS. 4 and 5 illustrate embodiments of flexible frames that can be used with the inventive suspension apparatus.

FIG. 4 illustrates an embodiment of the frame 201. In this embodiment, the frame 201 can be a generally rectangular shape with two vertical members 271 and two horizontal members 273. The frame 201 may be made entirely of a material such as aluminum, titanium, steel, plastic, carbon fiber, fiberglass, etc. The frame 201 can be tubing or rod and the cross section of the frame can be circular, rectangular or any other suitable shape. In some embodiments, it may be useful to have a frame 201 that is made of multiple materials. For example, since the frame 201 only bends along the length, the horizontal members 273 can be made of a more rigid material while the vertical members 271 may include sections that are more flexible. The flexibility of the vertical members 271 and horizontal members 273 can be controlled by the materials as well as the designs of the members. A steel material member may be more rigid than a plastic member having the same cross section. A thin tubular cross section, can be more flexible and lighter weight than a fat tubular cross section.

Figure 5:
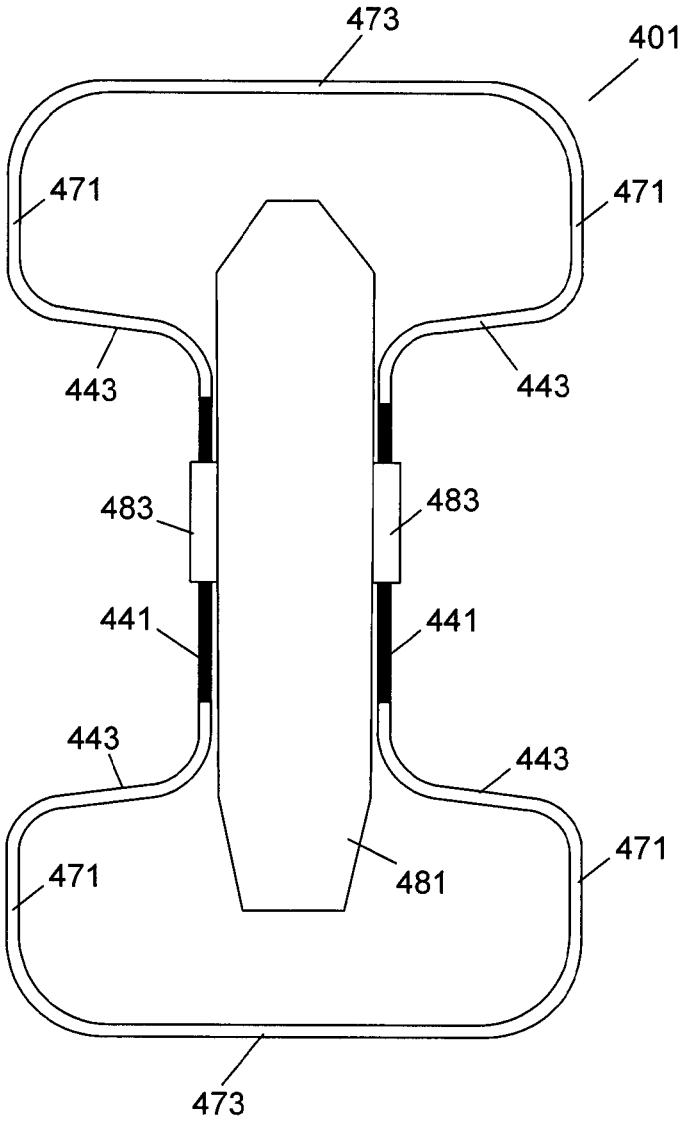

In other embodiments, the frame can have a more complex shape. FIG. 5 illustrates an alternative embodiment of the frame 401 that can include upper and lower horizontal members 473, middle horizontal members 443, upper and lower vertical members 471 and middle vertical members 441. As discussed, the different materials and member cross sections may have different mechanical properties. In the illustrated embodiment, the middle vertical members 441 can be made of a different material that is more flexible than the other members. When the frame 401 is bent as shown in FIG. 3, a bending force can be applied to all of the vertical members 441, 471 and a torsion force can be applied to the middle horizontal members 443. The bending movement can bend the vertical members 441, 471 and twist the middle horizontal members 443.

The frame 401 can be designed based upon the specific mechanical properties of the members and the expected normal use of the backpack. For example, for backpacks that are intended for only carrying light loads the frame can be designed to be more flexible since it may be unlikely that the load will too much for the flexible suspension system to handle. However, if the pack is designed for heavy loads a stiffer and more durable frame 401 may be necessary to prevent mechanical failure of the suspension system. The different horizontal and vertical members of the frame 401 can be different materials and have different mechanical designs. By accounting for the expected loads and knowing the mechanical properties of the backpack components, the required flexibility and durability of the frame 401 can be designed into the backpack.

FIG. 5 also illustrates a center pad 481 that is used to protect the user's spine and back from the shifting contents of the backpack when the frame 401 is in the flat configuration. Although the center pad 481 is illustrated as a solid structure, in other embodiments, the pad 481 can have perforations. The pad can be made of any suitable material including ethylene vinyl acetate (EVA), polyurethane, neoprene, etc. The center pad 481 can be coupled to the frame 401 with loops 483 so that the center pad 481 moves with the frame 401.

Figure 6:
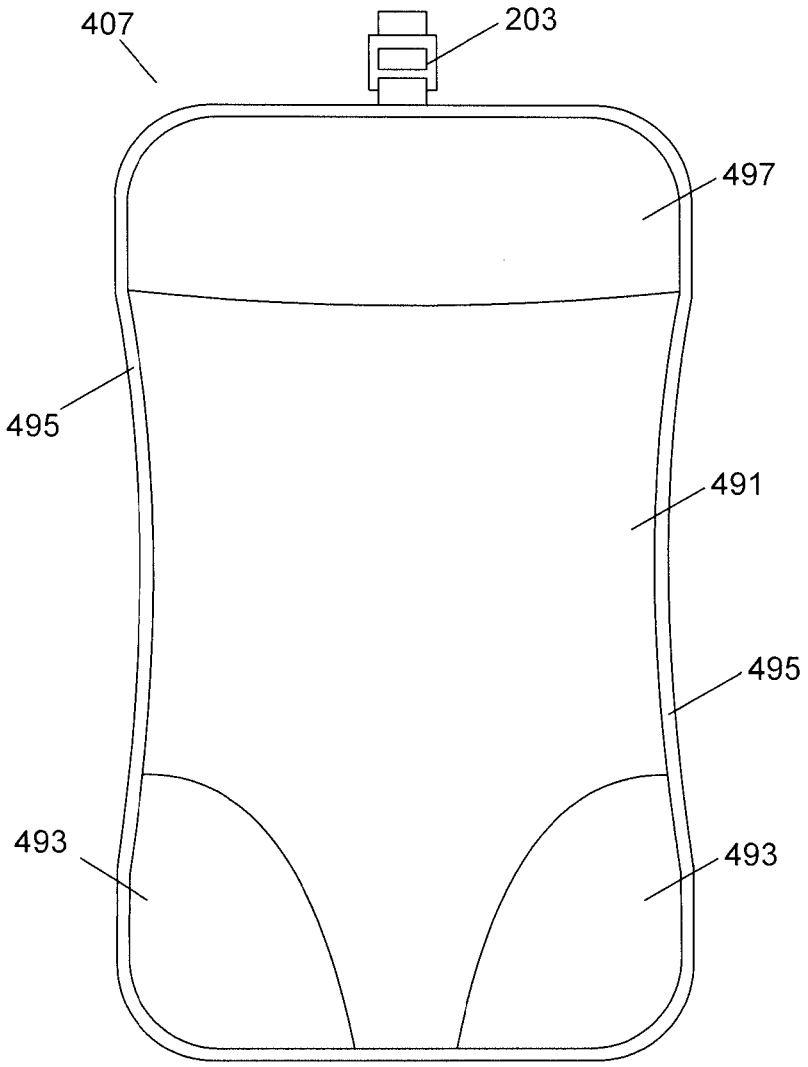
FIG. 6 illustrates an embodiment of the trampoline.

FIG. 6 illustrates an embodiment of the trampoline 407. The trampoline 407 can include a center material 491 which can be made of a highly breathable lightweight and elastic material such as nylon mesh. As discussed, the trampoline 407 can be connected to the frame at the bottom. In order to prevent the hard lower portions of the frame from bumping against the user, the trampoline can have padded sections 493 which can provide cushioning which can be made of EVA, polyurethane, neoprene, etc. The padded section 493 can be covered with a strong, flexible and durable material such as ballistic nylon. As discussed, the top of the trampoline 407 may include a stiff structure 497 which distributes the tension from the adjustment mechanism 203 across the width of the trampoline 407. This stiff structure 497 can be covered with padding since this area can be in direct contact with the user. The padded stiff structure 497 can also protect the user from the top of the frame. The perimeter 495 of the trampoline 407 may be made of a load bearing material such as ballistic nylon which can carry most of the tension applied by the variable suspension system. Since the load from the suspension system tension is carried by the perimeter 495, the center material 491 can be flexible and conform to the back of the user to provide a comfortable fit.

Figure 7:
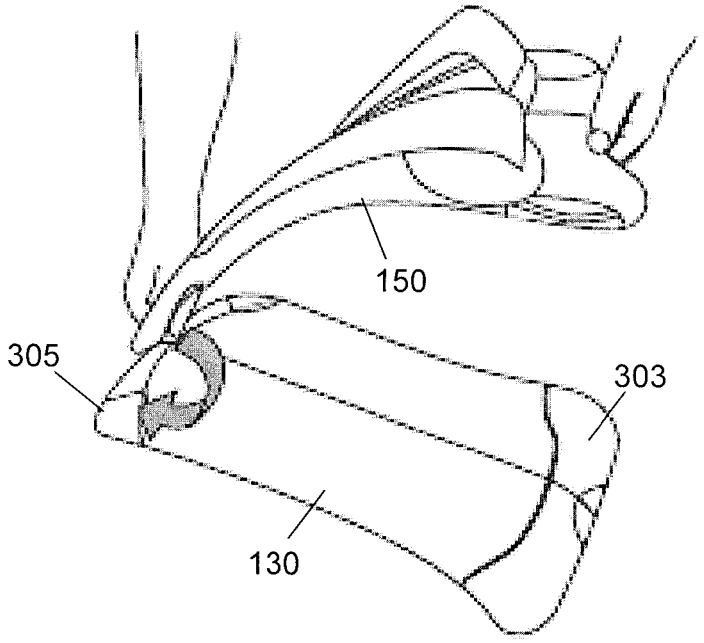
FIG. 7-9 illustrate a sequence of steps for connecting an embodiment of the inventive suspension apparatus to a storage pack.
Figure 8:
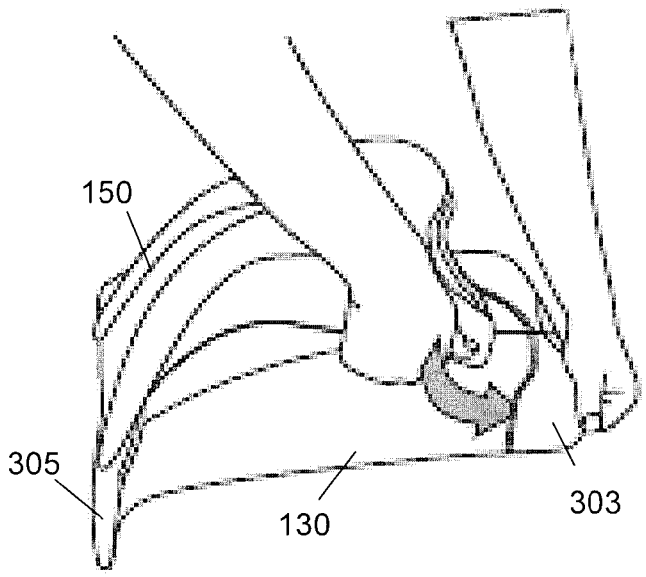
Figure 9:
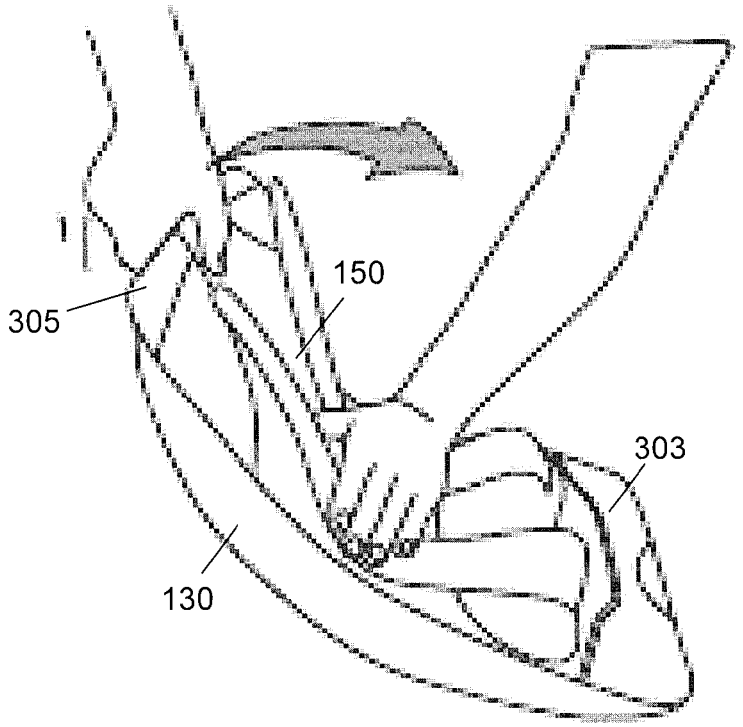

In an embodiment, the inventive suspension system can be removed from the pack. This feature can be useful if the suspension system has been damaged and needs to be replaced. Alternatively, it may be desirable to use the bag without the suspension system. FIGS. 7-9 illustrate an embodiment of a process for connecting the suspension system 150 to the pack 130. In this exemplary method, the user inserts the bottom of the suspension system 150 into the bottom pocket 305 of the pack 130 as shown in FIG. 7. The user then inserts the top portion of the suspension system 150 into the top pocket 303 of the pack 130 as shown in FIG. 8. During the installation the frame and suspension system 150 can be bent away from the pack 130. However, for proper operation the frame must be bent towards the pack 130. This is done by placing one end of the backpack 100 on a surface and elevating the opposite end of the backpack 100 while pressing the frame and suspension system 150 towards the pack 130 as shown in FIG. 9. To remove the suspension system 150 from the pack 130, the described connection procedures can be reversed.

It will be understood that the inventive system has been described with reference to particular embodiments, however additions, deletions and changes could be made to these embodiments without departing from the scope of the inventive system. Although the order filling apparatus and method have been described include various components, it is well understood that these components and the described configuration can be modified and rearranged in various other configurations.

What is claimed is:

1. A backpack suspension apparatus comprising: a frame having an upper section, a middle section and a lower section; a trampoline panel coupled between the upper section and the lower section of the frame; a stiff structure affixed to a top portion of the trampoline panel; and an adjustment mechanism coupled between the upper section of the frame and the top portion of the trampoline panel, the frame is held proximate to the trampoline panel in a substantially planar arrangement in a non-tensioned state when the adjustment mechanism is released, and the middle section of the frame is flexed away from the trampoline panel in a tensioned state when the adjustment mechanism is operated to pull the upper section of the frame down relative to the stiff structure in the top portion of the trampoline panel.

2. The backpack suspension apparatus of claim 1 wherein the adjustment mechanism is a strap that is tightened to increase the flex of the frame away from the trampoline panel and reduce a linear distance between the upper section and the lower section of the frame.

3. The backpack suspension apparatus of claim 1 wherein the adjustment mechanism is a strap that is loosened to decrease the flex of the frame away from the trampoline panel and increase a linear distance between the upper section and the lower section of the frame.

4. The backpack suspension apparatus of claim 1 further comprising:

a releasable coupling for releasably coupling the backpack suspension apparatus to a storage container.

5. The backpack suspension apparatus of claim 1 wherein the trampoline panel comprises a mesh material that allows air to circulate through at least a portion of the trampoline panel.

6. The backpack suspension apparatus of claim 1 wherein the flexible frame is in compression and at least a portion of the trampoline panel is in tension.

7. The backpack suspension apparatus of claim 1 further comprising: padding that is coupled to a portion of the frame.

8. The backpack suspension apparatus of claim 1 wherein a first portion of the frame bends and a second portion of the frame twists in torsion.

9. A backpack suspension apparatus comprising: a storage pack; a frame having an upper section, a middle section and a lower section, a convex side of the frame releasably coupled to a first side of the storage pack; a trampoline panel coupled between the upper section and the lower section of the frame; a stiff structure affixed to a top portion of the trampoline panel; and an adjustment mechanism coupled between the upper section of the frame and the top portion of the trampoline panel, the frame is held proximate to the trampoline panel in a substantially planar arrangement in a non-tensioned state when the adjustment mechanism is released, and the middle section of the frame is flexed away from the trampoline panel in a tensioned state when the adjustment mechanism is operated to pull the upper section of the frame down relative to the stiff structure in the top portion of the trampoline panel.

10. The backpack suspension apparatus of claim 9 wherein the adjustment mechanism is a strap that is tightened to increase the variable curvature of the frame and reduce a linear distance between the upper section and the lower section of the frame.

11. The backpack suspension apparatus of claim 9 wherein the suspension adjustment mechanism is a strap that is loosened to decrease the variable curvature of the frame and increase a linear distance between the upper section and the lower section of the frame.

12. The backpack suspension apparatus of claim 9 further comprising:

a releasable coupling for releasably coupling the backpack suspension apparatus to a storage container.

13. The backpack suspension apparatus of claim 9 wherein the trampoline panel comprises a mesh material that allows air to circulate through at least a portion of the trampoline panel.

14. The backpack suspension apparatus of claim 9 wherein the frame is in compression and at least a portion of the trampoline panel is in tension.

15. The backpack suspension apparatus of claim 9 wherein a first portion of the frame bends and a second portion of the frame twists in torsion.

16. The backpack suspension apparatus of claim 9 wherein at least a portion of the upper section of the frame is within a top pocket of the storage pack and at least a portion of the lower section of the frame is within a bottom pocket of the storage pack.

17. The backpack suspension apparatus of claim 1, the adjustment mechanism further operable to move the middle section of the flexible frame toward the trampoline panel.

18. The backpack suspension apparatus of claim 1, the flexible frame further comprising horizontal frame members and vertical frame members, the vertical frame members being more flexible than the horizontal frame members.

19. The backpack suspension apparatus of claim 9, the adjustment mechanism further operable to move the middle section of the flexible frame toward the trampoline panel.

20. The backpack suspension apparatus of claim 9, the flexible frame further comprising horizontal frame members and vertical frame members, the vertical frame members being more flexible than the horizontal frame members.

* * * * *